United States Patent [19]

Farkas, Jr.

[11] Patent Number: 4,720,101

[45] Date of Patent: Jan. 19, 1988

[54] BASKETBALL RETURN DEVICE

[75] Inventor: Louis Farkas, Jr., Windsor, Canada

[73] Assignee: 670161 Ontario Inc., Oldcastle, Canada

[21] Appl. No.: 54,239

[22] Filed: May 26, 1987

[51] Int. Cl.[4] ..... A63B 69/00

[52] U.S. Cl. ..... 273/1.5 A

[58] Field of Search ..... 273/1.5 A, 395, 396

[56] References Cited

U.S. PATENT DOCUMENTS 3,814,421 6/1974 Spier, Jr. ..... 273/1.5 A 4,579,339 4/1986 Grimm ..... 273/1.5 A 4,678,189 7/1987 Koss ..... 273/1.5 A

*Primary Examiner*—Paul E. Shapiro

*Attorney, Agent, or Firm*—Ridout & Maybee

[57] ABSTRACT

A basketball return device is attachable to a basketball hoop and comprises a chute member which is suspended beneath the hoop. The chute member has a ring from which depends a guideway for directing the return of a ball passing through the ring. The ring is freely rotatable on a track so that the guideway can be oriented to any radial direction about the hoop. The device is provided with telescoping arms for adjusting the distance between the hoop and the chute member.

6 Claims, 5 Drawing Figures

BASKETBALL RETURN DEVICE

The present invention is a device attachable to a basketball hoop for directing the return of a basketball which has passed through the hoop.

The basketball return device of the present invention possesses several features which render it more suitable for the purpose than previously proposed devices. The device comprises a chute member which is freely pivotable about the full 360° circumference of the basketball hoop in order to allow the user to choose any direction for return of the ball. The chute is suspended beneath the hoop by an annular track member having several arms which extend upwardly from the track to the hoop. The arms have means, such as snap fitting hooks, for attaching them to the hoop. Preferably, the arms are longitudinally adjustable so that the distance between the hoop and the chute can be varied somewhat in order to influence the trajectory of the ball leaving the chute. The components which make up the device may be conveniently molded from a suitable plastic.

Accordingly, the invention provides a basketball return device attachable to a basketball hoop which comprises a chute member for receiving a basketball and guiding it in a selected return direction away from the hoop. The chute member has a ring which is preferably planar and from which depend at least three ribs that form a guideway for the basketball which has passed through the ring. The guideway is formed to discharge the basketball well above the floor outwardly away from the hoop so that the ball may bounce along the return direction.

An annular track member operates to suspend the chute member beneath the hoop and provides a track surface upon which the ring of the chute member may slide to orient the chute in any return direction about the full 360° circumference of the hoop. The track member has at least three arms extending upwardly from the track surface. Each arm has means for adjusting the longitudinal extension thereof, and each arm has means for attaching it to the basketball hoop.

BRIEF DESCRIPTION OF THE DRAWINGS

Referring to FIG. 2, the preferred embodiment of the invention comprises two main elements, a chute member 10 and an annular track member 30. The chute member 10 has an upper ring 12 from which depend ribs 13 forming a guideway 15 for a basketball. The ribs 13 extend downwardly from the inner circumference of the ring 12 so that they do not interfere with the continuity of the bottom surface 16 of the ring 12.

Figure 1:
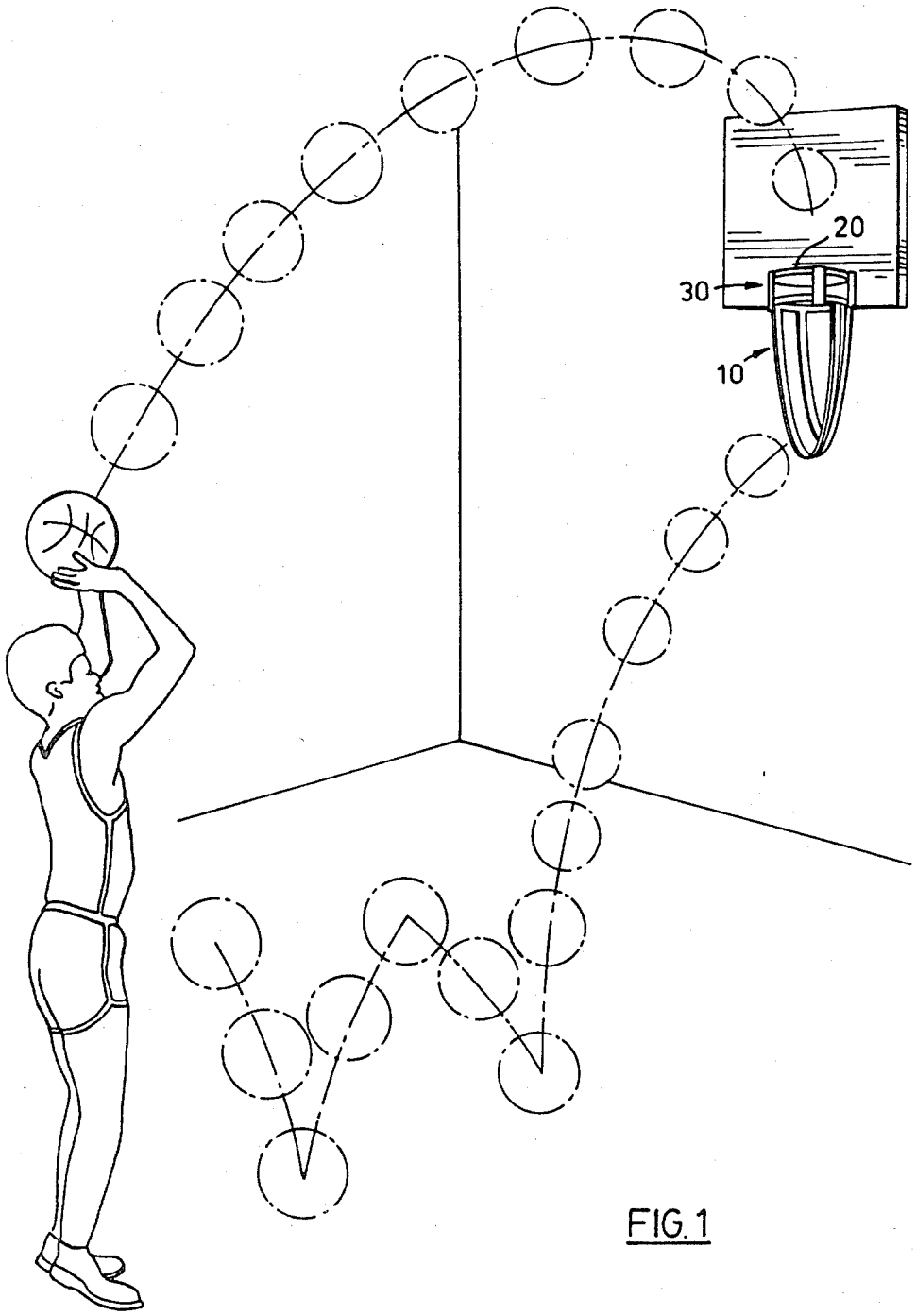
FIG. 1 is a perspective view of the device as installed, illustrating its use.

The annular track member 30 has a track 31 with an upper surface 32 for supporting the ring 12 of the chute member 10 and suspending the chute member 10 beneath a basketball hoop 20. When assembled, the bottom surface 16 of the ring 12 may freely slide on the supporting track surface 32 to allow the chute member 10 to be oriented in any direction radially about the hoop 20. Preferably the track surface 32 and the bottom surface 16 of the ring 12 are planar, but other surface configurations allowing the desired free rotation of the chute member 10 about the track member 30 are also within the scope of the invention.

Figures 2, 3:
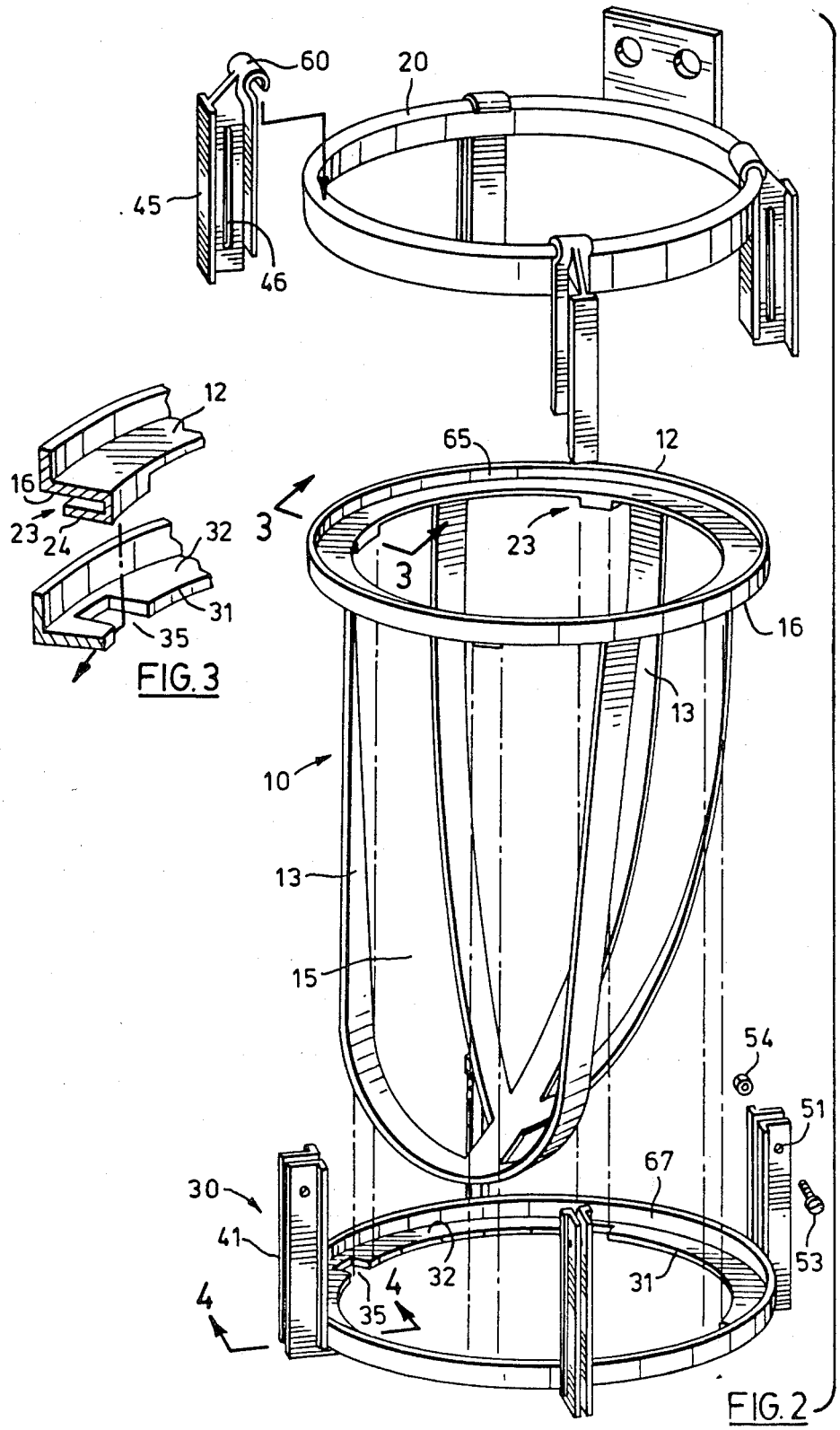
FIG. 2 is an exploded perspective view of the chute and track members which comprise the device.
FIG. 3 is a detail view of a preferred configuration of the interaction of the chute ring and the track.

Preferably the ring 12 is provided with guide means 23 which serve to fasten the chute member 10 to the track member 30 and to assist the smooth rotation of the chute member 10 about the track 31. A preferred guide means shown in FIGS. 2–4 comprises several fingers 24 spaced about the inner circumference of the ring 12 and extending toward the outer circumference beneath the bottom surface 16. The fingers 24 and the surface 16 define slots 26 for receiving the track 31. The chute member 10 is fastened to the track member 30 by providing the track 31 with notches 35 spaced thereabout so as to register with the fingers 24 on the ring 12.

The annular track member 30 has at least three arms 38 extending upwardly, preferably from the outer circumference of the track 31. The arms 38 are adjustable longitudinally so that the distance which the chute member 10 is suspended beneath the hoop 20 can be varied somewhat. This adjustability gives the user a degree of control over the trajectory of the ball leaving the guideway 15, and on full extension makes access to the chute member 10 easier for those not tall enough to reach the guideway 15 when attached close to the hoop 20.

Figure 4:
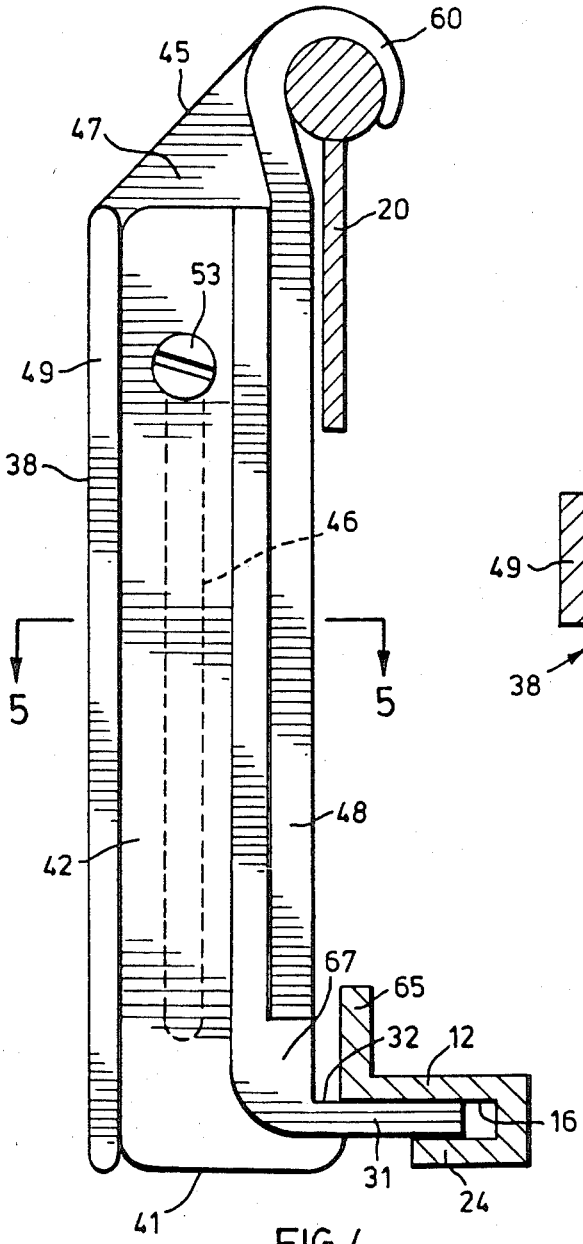
FIG. 4 is a detail side elevation view of a preferred arm configuration taken along line 4—4 in FIG. 3 showing adjustability thereof.
Figure 5:
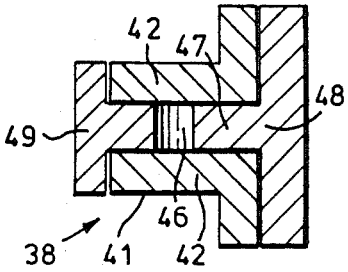
FIG. 5 is a sectional view of the arm taken along line 5—5 in FIG. 4.

A preferred means for adjusting the longitudinal extension of the arms 38 is to form each arm 38 from two pieces slidably joined in a rail and slot arrangement (FIGS. 4 and 5). Thus, a lower arm member 41 is attached to the track 31 and forms spaced rails 42 for guiding an upper I-beam shaped arm member 45 having a longitudinal slot 46 in the web 47 between inner and outer longitudinal flanges 48 and 49. The web 47 of the upper arm member 45 fits between the rails 42 and the flanges 48 and 49 ride on the inner and outer longitudinal edges of the rails 42. Holes 51 (FIG. 1) are provided transversely through the rails 42 near the upper end thereof which are in register with one another and the slot 46 in the upper arm 45. A bolt 53 is inserted through the holes 51 and the slot 46 of the assembled arm members 41 and 45, and a nut 54 is provided for the bolt 53 to tighten the arm 38 at the desired extension.

The upper arm members 45 are also provided with means for attaching the arms 38 and hence the device to the basketball loop 20. These means are preferably snap hooks 60, but other equally suitable means may be used.

The components which form the device of the invention may be made of a variety of materials, but it is felt that the device particularly lends itself to manufacture by plastic molding. For the preferred device shown in the drawings, upright annular flanges 65 and 67 are provided about the outer circumferences of the planar ring 12 and track 31 principally to provide structural rigidity to the plastic planar members 12 and 31.

It should be noted that while the drawings for clarity show the present device attached to a basketball hoop 20 from which the basket has been removed, this is not necessary and the device may be used in conjunction with the basket.

Variations of the preferred embodiment described herein will be apparent to the skilled person. The scope of the invention including such variants is defined in the claims which follow.

I claim:

1. A basketball return device attachable to a basketball hoop, comprising:

a chute member for receiving a basketball and guiding it in a selected return direction outwardly away from the hoop, the member having a ring from which depend at least three ribs forming a guideway for a basketball, the guideway being formed to discharge the basketball well above the floor so that the ball may bounce along the return direction; and an annular track member for suspending the chute member beneath the hoop having a track with a surface upon which the ring of the chute member may slide to orient the guideway in any return direction about the full 360° circumference of the hoop, the track member having at least three arms extending upwardly from the track, each arm having means for adjusting its longitudinal extension, and each arm having means for attaching it to the hoop.

2. A device as claimed in claim 1, further comprising guide means for fastening the chute member to the track member and for assisting the smooth rotation of the chute member about the track.

3. A device as claimed in claim 2, wherein the guide means comprises at least one finger attached at the inner circumference of the ring and which finger extends toward the outer circumference thereof beneath the bottom surface of the ring, the finger and the bottom surface of the ring defining a slot for receiving the track, the track defining notches opening to its inner circumference for receiving corresponding fingers on the ring, the notches being spaced about the track so as to register with the fingers spaced about the ring.

4. A device as claimed in claim 1, wherein the ring and track are both planar.

5. A device as claimed in claim 1, wherein the means for adjusting the longitudinal extension of each arm comprises a lower arm member attached to the track and forming a pair of spaced rails, an upper arm member having a central longitudinal web with orthogonally oriented flanges running along each longitudinal edge, the web defining a cehtral longitudinal slot, the web fitting between the rails of the lower arm member and the flanges being slidable along the longitudinal edges of the rails, the rails also having holes therethrough in register with the slot of the upper arm member for receiving a bolt to fasten the two arm members together, and a nut for the bolt to tighten the arm members together at a desired extension.

6. A device as claimed in claim 1, wherein the means for attaching each arm to the hoop comprises a hook provided near the end thereof.

* * * * *